US009530359B2

(12) United States Patent
Lee et al.

(10) Patent No.: US 9,530,359 B2
(45) Date of Patent: Dec. 27, 2016

(54) METHOD OF DRIVING BACKLIGHT UNIT AND DISPLAY DEVICE HAVING THE BACKLIGHT UNIT

(71) Applicant: Samsung Display Co., Ltd., Yongin, Gyeonggi-Do (KR)

(72) Inventors: Dae-Sik Lee, Asan-si (KR); Songyi Han, Asan-si (KR); SeungYoung Choi, Yongin-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/609,344

(22) Filed: Jan. 29, 2015

(65) Prior Publication Data

US 2016/0029449 A1 Jan. 28, 2016

(30) Foreign Application Priority Data

Jul. 22, 2014 (KR) ..... 10-2014-0092754

(51) Int. Cl.

| | |
|---|---|
| ***H05B 37/00*** | (2006.01) |
| ***G09F 13/04*** | (2006.01) |
| ***G09G 3/34*** | (2006.01) |
| ***H05B 33/08*** | (2006.01) |

(52) U.S. Cl.

CPC ..... *G09G 3/3406* (2013.01); *H05B 33/086* (2013.01); *H05B 33/0815* (2013.01)

(58) Field of Classification Search

CPC ..... G09F 13/04; G09F 13/08; H05B 37/00

USPC ..... 315/186, 307, 224, 294; 362/97.1, 97.3

See application file for complete search history.

(56) References Cited

U.S. PATENT DOCUMENTS

2010/0315016 A1* 12/2010 Hoogzaad ..... H05B 33/0818 315/224

FOREIGN PATENT DOCUMENTS

| | | | |
|---|---|---|---|
| KR | 10-2009-0018472 | A | 2/2009 |
| KR | 10-2013-0056085 | A | 5/2013 |
| KR | 10-2013-0130526 | A | 12/2013 |

* cited by examiner

*Primary Examiner* — Daniel D Chang
(74) *Attorney, Agent, or Firm* — Innovations Counsel LLP

(57) ABSTRACT

According to an exemplary embodiment, a display device includes a backlight unit and a display panel. The backlight unit comprises a single light emitting diode string with a plurality of light emitting diodes that are connected to each other in series and configured to emit light. The backlight unit also comprises a detector configured to generate a first voltage and a second voltage with respect to an output voltage for driving the single light emitting diode string, sample the first voltage at a predetermined time interval to generate a sample voltage, and compare a level of the sample voltage with a level of the second voltage to generate a compared result. The display panel is configured to receive light from the backlight unit to display an image. The compared result determines whether the output voltage is applied to the light emitting diode string.

17 Claims, 8 Drawing Sheets

METHOD OF DRIVING BACKLIGHT UNIT AND DISPLAY DEVICE HAVING THE BACKLIGHT UNIT

CROSS-REFERENCE TO RELATED APPLICATION

This U.S. non-provisional patent application claims priority under 35 U.S.C. §119 of Korean Patent Application No. 10-2014-0092754, filed on Jul. 22, 2014, the contents of which are hereby incorporated by reference in its entirety.

BACKGROUND

1. Field of Disclosure

The present disclosure relates to a method of driving a backlight unit and a display device having the backlight unit.

2. Description of the Related Art

In general, a display device includes a display panel for displaying an image and gate and data drivers for drive the display panel. The display panel includes gate lines, data lines, and pixels that are each connected to a corresponding gate line of the gate lines and a corresponding data line of the data lines. The gate lines receive gate signals from the gate driver and the data lines receive data voltages from the data driver. The pixels receive the data voltages provided through the data lines in response to the gate signals provided through the gate lines. The pixels display gray-scales that correspond to the data voltages such that desired images are displayed in the display panel.

The display device includes a backlight unit. The backlight unit may include a cold cathode fluorescent lamp (CCFL) or a light emitting diode (LED) as its light source to generate light.

To drive its light source, the backlight unit may require a converter driven by a direct current power source. To this end, the backlight unit may include a DC-to-DC converter that receives a low, direct current voltage and coverts the low, direct current voltage to a high, direct current voltage.

SUMMARY

The present disclosure provides a method of driving a backlight unit to block a current flowing to a light emitting diode when the light emitting diode is damaged.

The present disclosure provides a display device having the backlight unit driven by the driving method.

Embodiments of the present disclosure provide a method of driving a backlight unit, including generating a first voltage and a second voltage with respect to an output voltage required to generate a light, sampling the first voltage at a predetermined time interval to generate a sample voltage, comparing a level of the sample voltage with a level of the second voltage to generate a compared result, and outputting an operation control signal according to the compared result to indicate whether to apply an output voltage to a light source.

If the compared result indicates that the level of the sample voltage is higher than the level of the second voltage, the operation control signal may be maintained in an activated state that stops the output voltage from being applied to the light source.

If the compared result indicates that the level of the sample voltage is lower than the level of the second voltage, the operation control signal may be maintained in a non-activated state that enables the output voltage to be applied to the light source.

The second voltage controller may output the second voltage V2 higher than the first voltage V1 output from the first voltage controller when the output voltage remains the same.

The light source may include a single light emitting diode string with a plurality of light emitting diodes connected to each other in series.

Embodiments of the disclosure provide a display device including a backlight unit and a display panel. The backlight unit comprises a single light emitting diode string with a plurality of light emitting diodes that are connected to each other in series and configured to emit light, and a detector configured to generate a first voltage and a second voltage with respect to an output voltage for driving the single light emitting diode string, sample the first voltage at a predetermined time interval to generate a sample voltage, and compare a level of the sample voltage with a level of the second voltage to generate a compared result. The display panel is configured to receive light from the backlight unit to display an image. The compared result determines whether the output voltage is applied to the light emitting diode string.

The detector may be further configured to output an operation control signal based on the compared result.

The detector may further include a first voltage controller that is configured to output the first voltage with respect to the output voltage, a second voltage controller that is configured to output the second voltage with respect to the output voltage, a sampler that is configured to sample the first voltage at the predetermined time interval to generate the sample voltage, and a comparator that is configured to compare the sample voltage with the second voltage to output the operation control signal according to the compared result.

The second voltage controller may be configured to output the second voltage V2 at a higher level than that of the first voltage V1 output from the first voltage controller when the output voltage remains the same.

If the compared result indicates that one or more light emitting diodes are shorted among the light emitting diodes on the basis of the sample voltage being higher than the second voltage, the detector may output the operation control signal in an activated state that stops the output voltage from being applied to the light emitting diode string.

If the compared result indicates that one or more light emitting diodes are shorted among the light emitting diodes on the basis of the sample voltage being lower than the second voltage, the detector may output the operation control signal in a non-activated state that enables the output voltage to be applied to the light emitting diode string.

If the compared result indicates that one or more light emitting diodes are open among the light emitting diodes on the basis of the sample voltage being lower than the second voltage, the detector may output the operation control signal in an activated state that stops the output voltage from being applied to the light emitting diode string.

The backlight unit may include a DC-DC converter that is configured to convert an input voltage to the output voltage in response to a driving pulse signal in an activated state, a driving controller that is configured to control a duty ratio of the driving pulse signal controlling the output voltage, and a light source part that comprises the light emitting diode string and is configured to output the light in response to the output voltage.

If the compared result indicates that one or more light emitting diodes are shorted among the light emitting diodes on the basis of the sample voltage being higher than the second voltage level, the driving controller may output the driving pulse signal in the non-activated state in response to the operation control signal in the activated state to stop the output voltage from being outputted by the DC-DC converter.

The display device may further include a timing controller that is configured to control the backlight unit, and the timing controller controls the operation of the backlight unit in response to the operation control signal.

If the compared result indicates that one or more light emitting diodes are shorted among the light emitting diodes on the basis of the sample voltage being higher than the second voltage, the detector may apply the operation control signal in the activated state to the timing controller, and in response to the operation control signal in the activated state, the timing controller may stop the operation of the backlight unit.

If the compared result indicates one or more light emitting diodes are open among the light emitting diodes on the basis of the sample voltage being lower than the second voltage, the detector may apply the operation control signal in the activated state to the timing controller, and in response to the operation control signal in the activated state, the timing controller may stop the operation of the backlight unit.

According to the above, the drive reliability of the display device may be improved.

BRIEF DESCRIPTION OF THE DRAWINGS

The above and other advantages of the present disclosure are described below with reference to the accompanying drawings wherein.

DETAILED DESCRIPTION

It is understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the enumerated items.

It is understood that, although the terms first, second, etc. may be used herein to describe various elements, components, regions, layers and/or sections, these elements, components, regions, layers and/or sections are not limited by these terms. These terms are only used to distinguish one element, component, region, layer or section from another region, layer or section. Thus, a first element may be referred to as a second element without departing from the teachings of the present system and method.

Spatially relative terms, such as "beneath", "below", "lower", "above", "upper" and the like, may be used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. In such case, the exemplary term "below" encompasses both an orientation of above and below, depending on how the device is oriented relative to the orientation shown in the figures. That is, in whichever way the device may be oriented (e.g., rotated 90 degrees or at other orientations) relative to that shown in the figures, the spatially relative descriptors used herein are to be interpreted accordingly.

The terminologies used herein are for the purpose of describing particular embodiments only and are not intended to be limiting of the present system and method. As used herein, the singular forms, "a", "an" and "the" are intended to include the plural forms as well, unless the context clearly indicates otherwise. It is further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present system and method are described with reference to the accompanying drawings.

Figure 1:
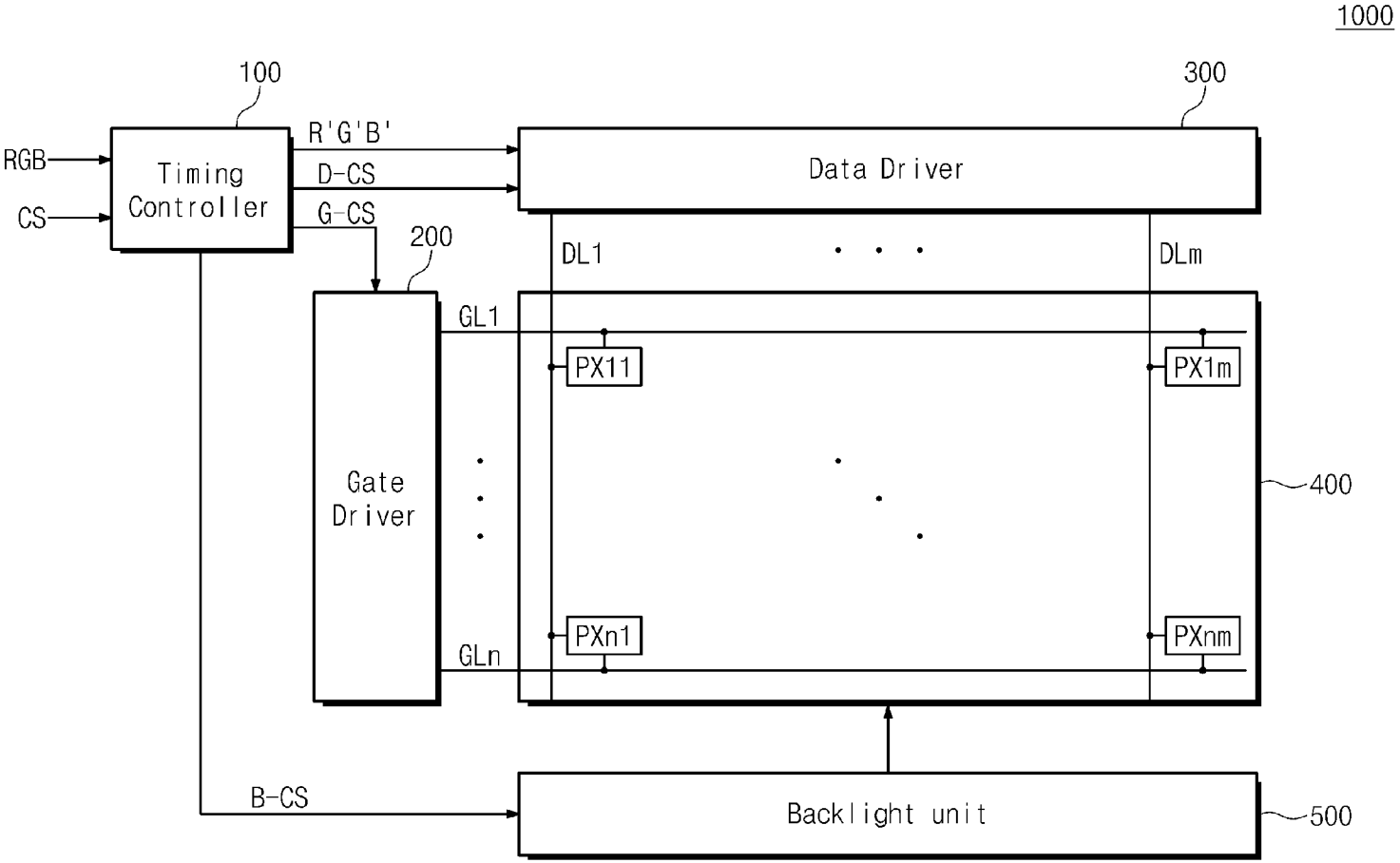
FIG. 1 is a block diagram showing a display device, according to an exemplary embodiment of the present disclosure.

FIG. 1 is a block diagram showing a display device 1000, according to an exemplary embodiment of the present disclosure. Referring to FIG. 1, the display device 1000 includes a timing controller 100, a gate driver 200, a data driver 300, a display panel 400, and a backlight unit 500.

The timing controller 100 receives a plurality of image signals RGB and a plurality of control signals CS from an external source (not shown). The timing controller 100 converts the data format of the image signal RGB to a data format appropriate for interfacing between the timing controller 100 and the data driver 300 and generates image signals R'G'B' having the converted data format. The image signals R'G'B' are applied to the data driver 300.

The timing controller 100 generates a data control signal D-CS and a gate control signal G-CS in response to the control signals CS. According to an exemplary embodiment, the data control signal D-CS includes an output start signal and a horizontal start signal, and the gate control signal G-CS includes a vertical start signal and a vertical clock bar signal. The timing controller 100 applies the data control signal D-CS to the data driver 300 and the gate control signal G-CS to the gate driver 200.

The timing controller 100 also generates a backlight control signal B-CS to control the backlight unit 500. The timing controller 100 applies the backlight control signal B-CS to the backlight unit 500. According to an exemplary embodiment, the backlight control signal B-CS includes a control signal for stopping an operation of the backlight unit 500. Consider an example in which the backlight unit 500 includes a plurality of light emitting diodes. When one of the light emitting diodes is shorted, the timing controller 100 may output the control signal to stop the operation of the backlight unit 500.

The gate driver 200 generates gate signals in response to the gate control signal G-CS provided from the timing controller 100. The gate driver 200 sequentially applies the gate signals to the display panel 400 through the gate lines GL1 to GLn. That is, pixels PX11 to PXnm included in the display panel 400 are sequentially scanned by the gate signals being applied to the rows of pixels.

The data driver 300 converts the image signals R'G'B' to data voltages in response to the data control signal D-CS provided from the timing controller 100. The data driver 300 applies the data voltages to the display panel 400 through data lines DL1 to DLm.

The display panel 400 includes the gate lines GL1 to GLn, the data lines DL1 to DLm, and the pixels PX11 to PXnm. The gate lines GL1 to GLn extend in a row direction and are arranged in a column direction to cross the data lines DL1 to DLm extending in the column direction. The gate lines GL1 to GLn are electrically connected to the gate driver 200 and receive the gate signals. The data lines DL1 to DLm are electrically connected to the data driver 300 and receive the data voltages. Each of the pixels PX11 to PXnm is connected to a corresponding gate line of the gate lines GL1 to GLn and a corresponding data line of the data lines DL1 to DLm.

The backlight unit 500 supplies light to the display panel 400 and may include light emitting diodes as a light source. For example, the backlight unit 500 may include a single light emitting diode string with a plurality of light emitting diodes connected to each other in series.

The backlight unit 500 DC-DC converts an input voltage from the external source (not shown) and generates an output voltage to drive the light source. However, an overcurrent phenomenon may occur when the backlight unit 500 converts the input voltage to the output voltage. As a result, one or more light emitting diodes of the light emitting diodes may be damaged by a short circuit phenomenon or an open circuit phenomenon.

A conventional backlight unit employing a single light emitting diode string continues to apply the output voltage to the single light emitting diode string even though a portion of the light emitting diode string is damaged. As a result, the conventional backlight unit continues to output light after the single light emitting diode string is partially damaged, and the driving reliability of the display device is lowered.

In contrast, the backlight unit 500 according to an exemplary embodiment of the present system and method detects the damage of the light emitting diodes and blocks the output voltage from being applied to the light emitting diodes. A method of blocking the output voltage from being applied is described later with reference to FIG. 3.

Figure 2:
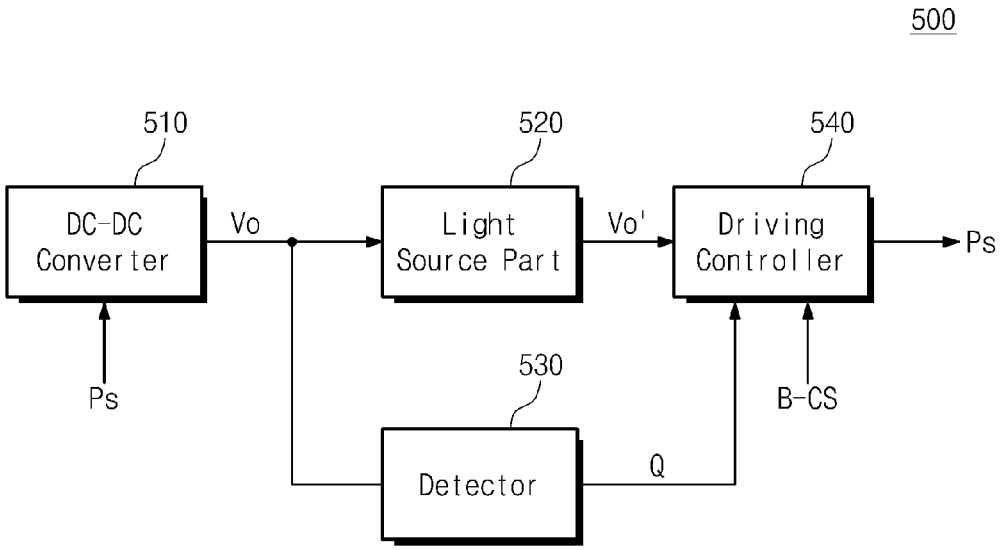
FIG. 2 is a block diagram showing a backlight unit shown in FIG. 1, according to an exemplary embodiment.

FIG. 2 is a block diagram showing the backlight unit 500 shown in FIG. 1, according to an exemplary embodiment. Referring to FIG. 2, the backlight unit 500 includes a DC-DC converter 510, a light source part 520, a detector 530, and a driving controller 540.

The DC-DC converter 510 receives the input voltage from the external source (not shown). The DC-DC converter 510 converts the input voltage to the output voltage Vo to drive the light source part 520. The DC-DC converter 510 applies the converted output voltage Vo to the light source part 520.

The light source part 520 receives the output voltage Vo from the DC-DC converter 510 and generates light in response to the output voltage Vo. The light source part 520 may include a single light emitting diode string with a plurality of light emitting diodes connected to each other in series. The light source part 520 is electrically connected to the driving controller 540 and applies an output voltage Vo' output to the driving controller 540.

In general, the level of the output voltage Vo' output from the light source part 520 is not changed by the single light emitting diode string because the output voltage Vo' is controlled by the driving controller 540. For instance, if one light emitting diode that requires a voltage level of about 1V is damaged, the driving controller 540 instructs the DC-DC converter 510 to reduce the output voltage Vo to the light source part 520 by about 1V. As a result, the level of the output voltage Vo' output from the light source part 520 is not changed. This also means it would be difficult to detect whether one or more of the light emitting diodes are damaged based on the level of the output voltage Vo' from the light source part 520. Therefore, the backlight unit 500 according to an exemplary embodiment detects whether one or more of the light emitting diodes are damaged based on a variation in the level of the output voltage Vo applied to the light source part 520, rather than based on the output voltage Vo' output from the light source part 520.

The detector 530 receives the output voltage Vo output from the DC-DC converter 510. The detector 530 detects whether the light emitting diodes are damaged based on the received output voltage Vo. According to an exemplary embodiment, the detector 530 applies an operation control signal Q to the driving controller 540 that reflects the detected result. For example, if the detector 530 detects damage, the operation control signal Q may stop the output voltage Vo from being applied to the light source part 520. Although not shown in the figures, the detector 530 also applies the operation control signal Q to the timing controller 100 (refer to FIG. 1).

The driving controller 540 controls the output voltage Vo in response to the backlight control signal B-CS provided from the timing controller 100. The driving controller 540 also controls the DC-DC converter 510 to stop the DC-DC converter 510 from applying the output voltage Vo to the light source part 520 if the operation control signal Q provided from the detector 530 is in an activated state.

Figure 3:
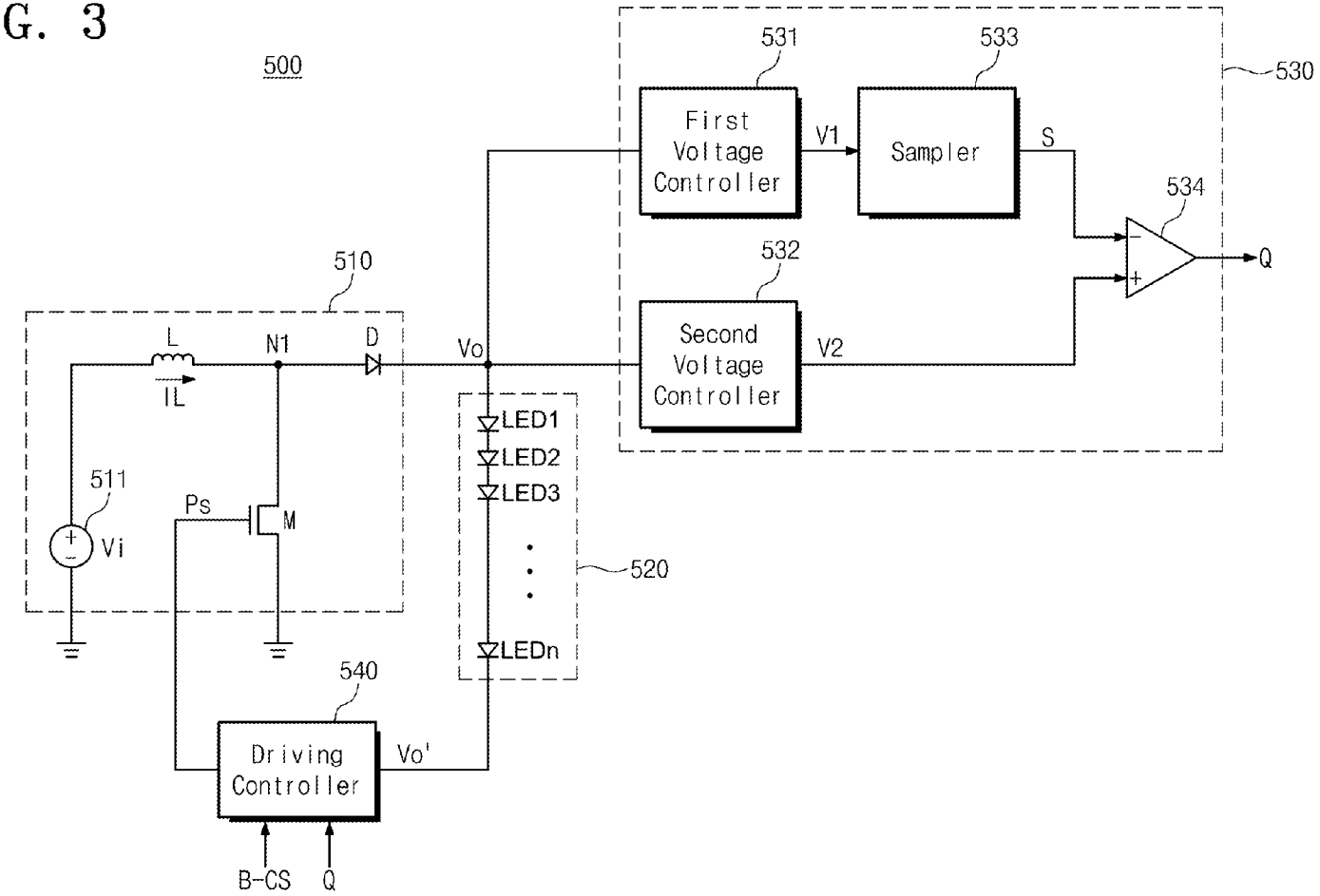
FIG. 3 is a circuit diagram showing the backlight unit shown in FIG. 1, according to an exemplary embodiment.

FIG. 3 is a circuit diagram showing the backlight unit 500 shown in FIG. 1, according to an exemplary embodiment. Referring to FIG. 3, the DC-DC converter 510 includes an input power source 511, an inductor L, a driving transistor M, and a diode D. The DC-DC converter 510 DC-DC converts the input voltage Vi to the output voltage Vo for driving the backlight unit 500.

The input power source 511 is connected between a ground terminal and one end of the inductor L. The input power source 511 generates the input voltage Vi having a direct current component. The one end of the inductor L is connected to the input power source 511 and the other end of the inductor L is connected to a first node N1. The inductor L is charged with a driving current IL and outputs the driving current in response to the input voltage Vi.

According to an exemplary embodiment, the driving transistor M is an NMOS transistor disposed between the first node N1 and the ground terminal A drain terminal of the driving transistor M is connected to the first node N1, a source terminal of the driving transistor M is connected to the ground terminal, and a gate terminal of the driving transistor M is connected to the driving controller 540. That is, the driving transistor M is operated in response to a driving pulse signal Ps output from the driving controller 540.

When the driving transistor M is turned on in response to the driving pulse signal Ps, the level of the driving current IL starts to increase in accordance with the input voltage Vi. In this case, since the diode D is not activated, the current output through the inductor L is not applied to an output terminal of the diode D. Instead, the current provided to the first node N1 through the inductor L is applied to the driving transistor M.

When the driving transistor M is turned off in response to the driving pulse signal Ps, the driving current IL charged in the inductor L is applied to the light source part 520 through the diode D. In this case, because the diode D is activated, the level of the driving current IL starts to decrease. In addition, when the driving transistor M is turned off, a voltage level obtained by adding the output voltage to the input voltage Vi of the inductor L is applied to the first node N1, thus increasing the output voltage Vo.

The light source part 520 of FIG. 3 is realized by a single light emitting diode string with light emitting diodes LED1 to LEDn. The light source part 520 supplies light to the display panel 400 (refer to FIG. 1) in response to the output voltage Vo output from the DC-DC converter 510.

The detector 530 includes a first voltage controller 531, a second voltage controller 532, a sampler 533, and a comparator 534. The first voltage controller 531 converts the output voltage Vo to a first voltage V1. The second voltage controller 532 converts the output voltage Vo to a second voltage V2. The second voltage controller 532 applies the second voltage V2 to a second terminal (+) of the comparator.

The sampler 533 samples the first voltage V1 as an analog signal at a predetermined interval of time and outputs a sample voltage S. For instance, if the sampler 533 samples the first voltage V1 at an interval of one second, the sample voltage S is applied to the comparator 534 at the interval of one second. That is, the sample voltage S maintained at the same voltage level during one second is applied to a first terminal (−) of the comparator 534.

The comparator 534 receives the sample voltage S and the second voltage V2 from the sampler 533 and the second voltage controller 532, respectively. The comparator 534 compares the sample voltage S and the second voltage V2 and outputs the operation control signal Q according to the compared result.

According to an exemplary embodiment, the second voltage controller 532 may output the second voltage V2 higher than the first voltage V1 output from the first voltage controller 531 when one or more light emitting diodes are shorted among the light emitting diodes LED1 to LEDn.

According to an exemplary embodiment, the first voltage controller 531 may output the first voltage V1 higher than the second voltage V2 output from the second voltage controller 532 when one or more light emitting diodes are open-circuited, or open, among the light emitting diodes LED1 to LEDn.

The operation of the comparator 534 when one or more light emitting diodes of the light emitting diodes LED1 to LEDn are shorted or open are described with reference to FIGS. 4 to 7.

The driving controller 540 outputs the driving pulse signal Ps in response to the backlight control signal B-CS. Particularly, the driving controller 540 controls a duty ratio of the driving pulse signal Ps to control the voltage level of the inductor L. As a result, the level of the output voltage Vo may be controlled.

As an example, when the driving controller 540 outputs the driving pulse signal Ps in the activated state, the driving transistor M is turned on and the voltage level of the inductor L increases. When the driving controller 540 outputs the driving pulse signal Ps in the non-activated state, the driving transistor M is turned off and the level obtained by adding the output voltage to the input voltage Vo of the inductor L is applied to the light source part 520 as the output voltage Vo.

The driving controller 540 receives the operation control signal Q from the detector 530. The driving controller 540 controls the DC-DC converter 510 in response to the operation control signal Q so as to stop the output voltage Vo from being applied to the light source part 520. According to an exemplary embodiment, when the operation control signal Q is in the activated state and applied to the driving controller 540, the driving controller 540 continuously applies the driving pulse signal Ps in the non-activated state to the driving transistor M. As a result, the DC-DC converter 510 does not apply the output voltage Vo to the light source part 520.

As described above, the detector 530 outputs the operation control signal Q in the activated state through the comparator 534 when one or more light emitting diodes of the light emitting diodes LED1 to LEDn are shorted or open. In response to receiving the operation control signal Q in the activated state, the driving controller 540 controls the operation of the light source part 520. As a result, the circuits of the light source part 520 and the backlight unit 500 are protected.

Figure 4:
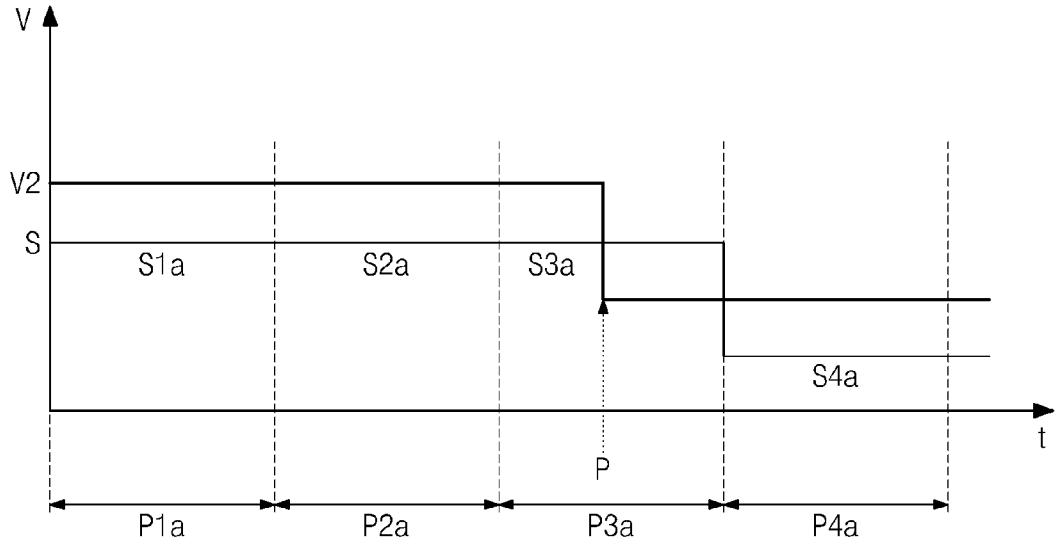
FIG. 4 is a timing diagram showing an operation of a detector shown in FIG. 3, according to an exemplary embodiment of the present disclosure.
Figure 5:
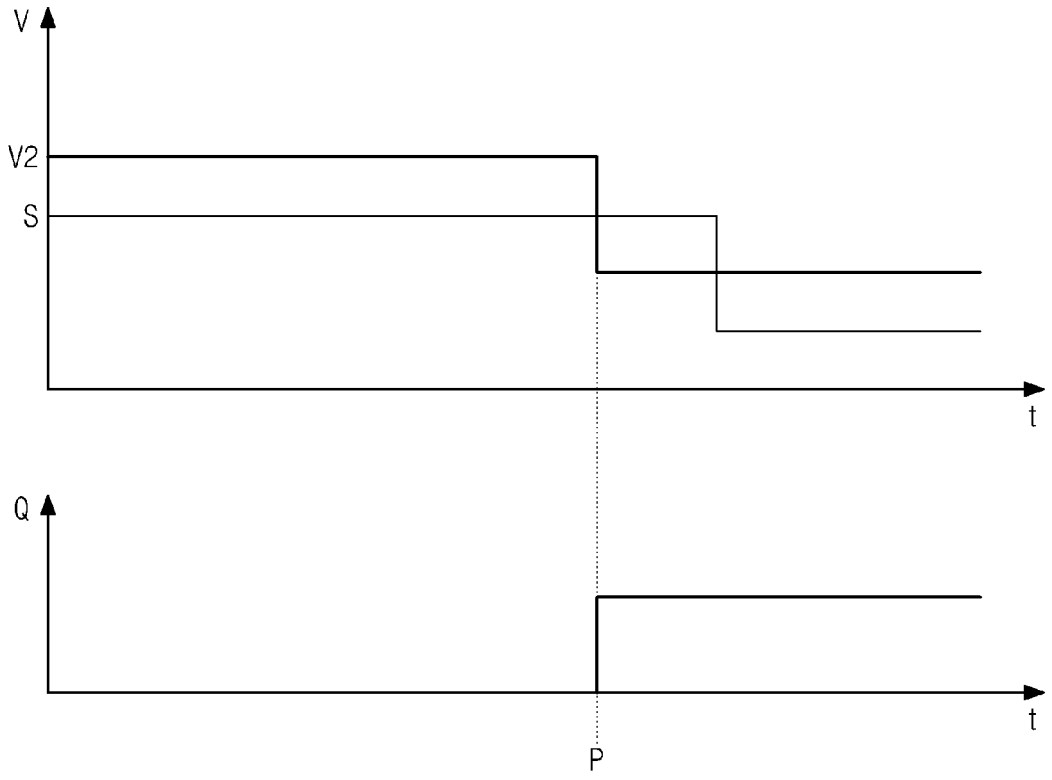
FIG. 5 is a timing diagram showing an operation control signal output from the detector on the basis of the operation of the detector shown in FIG. 4.

FIG. 4 is a timing diagram showing the operation of the detector 530 shown in FIG. 3, according to an exemplary embodiment of the present disclosure. FIG. 5 is a timing diagram showing the operation control signal output from the detector 530 on the basis of the operation of the detector 530 shown in FIG. 4. Hereinafter, the operation of the detector 530 are described with reference to FIGS. 3 to 5 for a case when one or more light emitting diodes of the light emitting diodes LED1 to LEDn are shorted.

In FIGS. 4 and 5, a horizontal axis indicates a time (t) and a vertical axis indicates a voltage level (V). When a light emitting diode is shorted, the level of the output voltage Vo applied to the light source part 520 decreases. This is because the output voltage required by the light source part 520 decreases when the voltage is not used in the shorted light emitting diode.

Based on the output voltage level, the first voltage controller 531 generates the first voltage V1 and the second voltage controller 532 generates the second voltage V2. Here, the first voltage V1 is generally set to have a level lower than that of the second voltage V2.

The sampler 533 samples the first voltage V1 at predetermined time intervals. FIG. 4 shows the sampler 533 sampling the first voltage V1 in four intervals P1*a* to P4*a*. The first to fourth intervals P1*a* to P4*a* are the same in length. The level of the sample voltage S may vary depending on the variation of the output voltage Vo in each of the first to fourth intervals P1*a* to P4*a*. However, the sampling method of the first voltage V1 should not be limited to the above-mentioned method.

During the first interval P1*a*, the sampler 533 outputs a first sample voltage S1*a* and the second voltage controller 532 outputs the second voltage V2 with reference to the output voltage Vo. The first sample voltage S1*a* is maintained at the same voltage level during the first interval P1*a*, whereas the second voltage V2 may be controlled in accordance with the variation of the output voltage Vo (i.e., may not remain at the same level during the interval). In addition, the comparator 534 outputs the operation control signal Q in the non-activated state, i.e., a low level, since the second voltage V2 is higher than the first sample voltage S1*a*.

During the second interval P2*a*, the sampler 533 outputs a second sample voltage S2*a* and the second voltage controller 532 outputs the second voltage V2 with reference to the output voltage Vo. The second sample voltage S2*a* is maintained at the same voltage level during the second interval P2*a*, whereas the second voltage V2 may be controlled in accordance with the variation of the output voltage Vo. In addition, the comparator 534 outputs the operation control signal Q in the non-activated state, i.e., the low level, since the second voltage V2 is higher than the second sample voltage S2*a*.

During the third interval P3*a*, the sampler 533 outputs a third sample voltage S3*a* and the second voltage controller 532 outputs the second voltage V2 with reference to the output voltage Vo. The third sample voltage S3*a* is maintained at the same voltage level during the third interval P3*a*. The level of the second voltage V2, however, decreased at time P in the third interval P3*a* due to the variation of the output voltage Vo. That is, when one or more light emitting diodes of the light emitting diodes LED1 to LEDn are shorted, the level of the output voltage Vo decreases under the control of the driving controller 540. In response to the decreased level of the output voltage Vo, the second voltage controller 532 outputs the second voltage V2 having the decreased level in the period P in the third interval P3*a*.

Accordingly, the comparator 534 outputs the operation control signal Q in the activated state, i.e., a high level, after time P in the third interval P3*a* since the second voltage V2 is lower than the third sample voltage S3*a* after time P. As a result, the driving controller 540 outputs the driving pulse signal Ps in the non-activated state in response to the operation control signal Q in the activated state. The driving pulse signal Ps in the non-activated state stops the DC-DC converter 510 from outputting the output voltage Vo, to the light source part 520.

According to an exemplary embodiment, the comparator 534 may apply the operation control signal Q in the activated state to the timing controller 100 (refer to FIG. 1) rather than the driving controller 540. In turn, the timing controller 100 may generate the backlight control signal B-CS in response to the operation control signal Q in the activated state to stop the operation of the backlight unit 500. That is, the backlight unit 500 may stop its operation in response to the backlight control signal B-CS.

During the fourth interval P4*a*, the sampler 533 outputs a fourth sample voltage S4*a* and the second voltage controller 532 outputs the second voltage V2 with reference to the output voltage Vo. During the fourth interval P4*a*, the fourth sample voltage S4*a* is maintained at a level lower than that of the third sample voltage S3*a* due to the decreased output voltage Vo after time P. The fourth sample voltage S4*a* is maintained at the same voltage level during the fourth interval P4*a*, whereas the second voltage V2 may be controlled depending on the variation of the output voltage Vo.

Even though FIG. 4 shows that the second voltage V2 is higher than the fourth sample voltage S4*a* in the fourth interval P4*a*, the comparator 534 continues to output the operation control signal Q in the activated state (see FIG. 5) until an initialization setting process is performed by an external control. That is, the operation control signal Q is maintained in the activated state during the fourth interval P4*a*.

Figure 6:
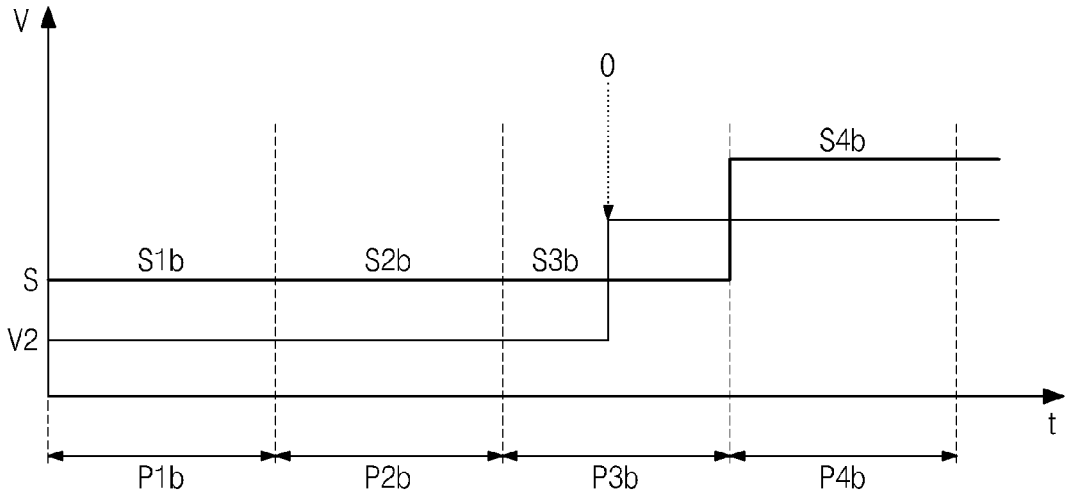
FIG. 6 is a timing diagram showing an operation of a detector shown in FIG. 3, according to another exemplary embodiment of the present disclosure.
Figure 7:
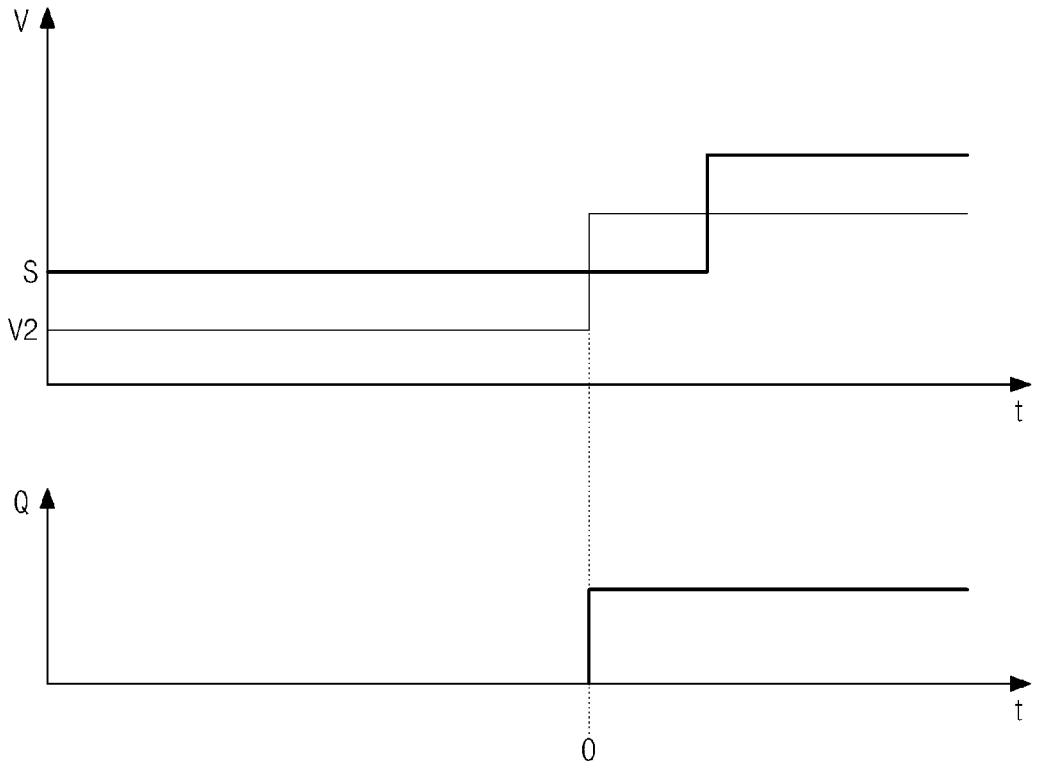
FIG. 7 is a timing diagram showing an operation control signal output from the detector on the basis of the operation of the detector shown in FIG. 6.

FIG. 6 is a timing diagram showing an operation of a detector shown in FIG. 3, according to another exemplary embodiment of the present disclosure. FIG. 7 is a timing diagram showing an operation control signal output from the detector on the basis of the operation of the detector shown in FIG. 6.

Hereinafter, the operation of the detector 530 is described with reference to FIGS. 3, 6, and 7 for a case when one or more light emitting diodes of the light emitting diodes LED1 to LEDn are open. In FIGS. 6 and 7, a horizontal axis indicates a time (t) and a vertical axis indicates a voltage level (V).

When a light emitting diode is open, the level of the output voltage Vo applied to the light source part 520 generally increases. This is because, in general, each light emitting diode LEDn is connected in parallel to a zener diode (not shown) that turns on at a voltage level higher than the light emitting diode LEDn. When the light emitting diode LEDn is open, the zener diode is used. Thus, the output voltage to drive the light source part 520 may increase due to an open light emitting diode.

Although not shown in figures, when the detector 530 is configured to detect whether a light emitting diode LEDn is open, the first terminal of the comparator 534 may be set to a positive (+) polarity and the second terminal of the comparator 534 may be set to a negative (−) polarity (i.e., reverse of what is shown in FIG. 3 for detecting a shorted light emitting diode). That is, in such case, the second voltage controller 532 applies the second voltage V2 to the second terminal (−) of the comparator 534 and the sampler 533 applied the sample voltage S to the first terminal (+) of the comparator 534.

Based on the output voltage level, the first voltage controller 531 generates the first voltage V1 and the second voltage controller 532 generates the second voltage V2. Here, the first voltage V1 is generally set to have a level higher than that of the second voltage V2.

The sampler 533 samples the first voltage V1 at predetermined time intervals. FIG. 6 shows the sampler 533 sampling the first voltage V1 in four intervals P1*b* to P4*b*. The first to fourth intervals P1*b* to P4*b* are the same in length. The level of the sample voltage S may vary depending on the variation of the output voltage Vo in each of the first to fourth intervals P1*b* to P4*b*.

During the first interval P1*b*, the sampler 533 outputs a first sample voltage S1*b* and the second voltage controller 532 outputs the second voltage V2 with reference to the output voltage Vo. The first sample voltage S1*b* is maintained at the same voltage level during the first interval P1*b*, whereas the second voltage V2 may be controlled in accordance with the variation of the output voltage Vo. In addition, the comparator 534 outputs the operation control signal Q in the non-activated state, i.e., a low level, since the second voltage V2 is lower than the first sample voltage S1*b*.

During the second interval P2*b*, the sampler 533 outputs a second sample voltage S2*b* and the second voltage controller 532 outputs the second voltage V2 with reference to the output voltage Vo. The second sample voltage S2*b* is maintained at the same voltage level during the second interval P2*b*, whereas the second voltage V2 may be controlled in accordance with the variation of the output voltage Vo. In addition, the comparator 534 outputs the operation control signal Q in the non-activated state, i.e., the low level, since the second voltage V2 is higher than the second sample voltage S2*b*.

During the third interval P3*b*, the sampler 533 outputs a third sample voltage S3*b* and the second voltage controller 532 outputs the second voltage V2 with reference to the output voltage Vo. The third sample voltage S3*b* is maintained at the same voltage level during the third interval P3*b*. The level of the second voltage V2, however, increased at time O in the third interval P3*b* due to the variation of the output voltage Vo. That is, when one or more light emitting diodes of the light emitting diodes LED1 to LEDn are open, the level of the output voltage Vo increases because the zener diode is being used instead of the open light emitting diode. The level of the output voltage Vo may be under the control of the driving controller 540. In response to the increased level of the output voltage Vo, the second voltage controller 532 outputs the second voltage V2 having the increased level in the period O in the third interval P3*b*.

Accordingly, the comparator 534 outputs the operation control signal Q in the activated state, i.e., a high level, after time O in the third interval P3*b* since the second voltage V2 is higher than the third sample voltage S3*b* after time O. As a result, the driving controller 540 outputs the driving pulse signal Ps in the non-activated state in response to the operation control signal Q in the activated state. The driving pulse signal Ps in the non-activated state stops the DC-DC converter 510 from outputting the output voltage Vo to the light source part 520.

During the fourth interval P4*b*, the sampler 533 outputs a fourth sample voltage S4*b* and the second voltage controller 532 outputs the second voltage V2 with reference to the output voltage Vo. During the fourth interval P4*b*, the fourth sample voltage S4*b* is maintained at a level higher than that of the third sample voltage S3*b* due to the increased output voltage Vo after time O. The fourth sample voltage S4*b* is maintained at the same voltage level during the fourth interval P4*b*, whereas the second voltage V2 may be controlled depending on the variation of the output voltage Vo.

Even though FIG. 6 shows that the second voltage V2 is lower than the fourth sample voltage S4*b* in the fourth interval P4*b*, the comparator 534 continues to output the operation control signal Q in the activated state (see FIG. 7) until the initialization setting process is performed by the external control. That is, the operation control signal Q is maintained in the activated state during the fourth interval P4*b*.

Figure 8:
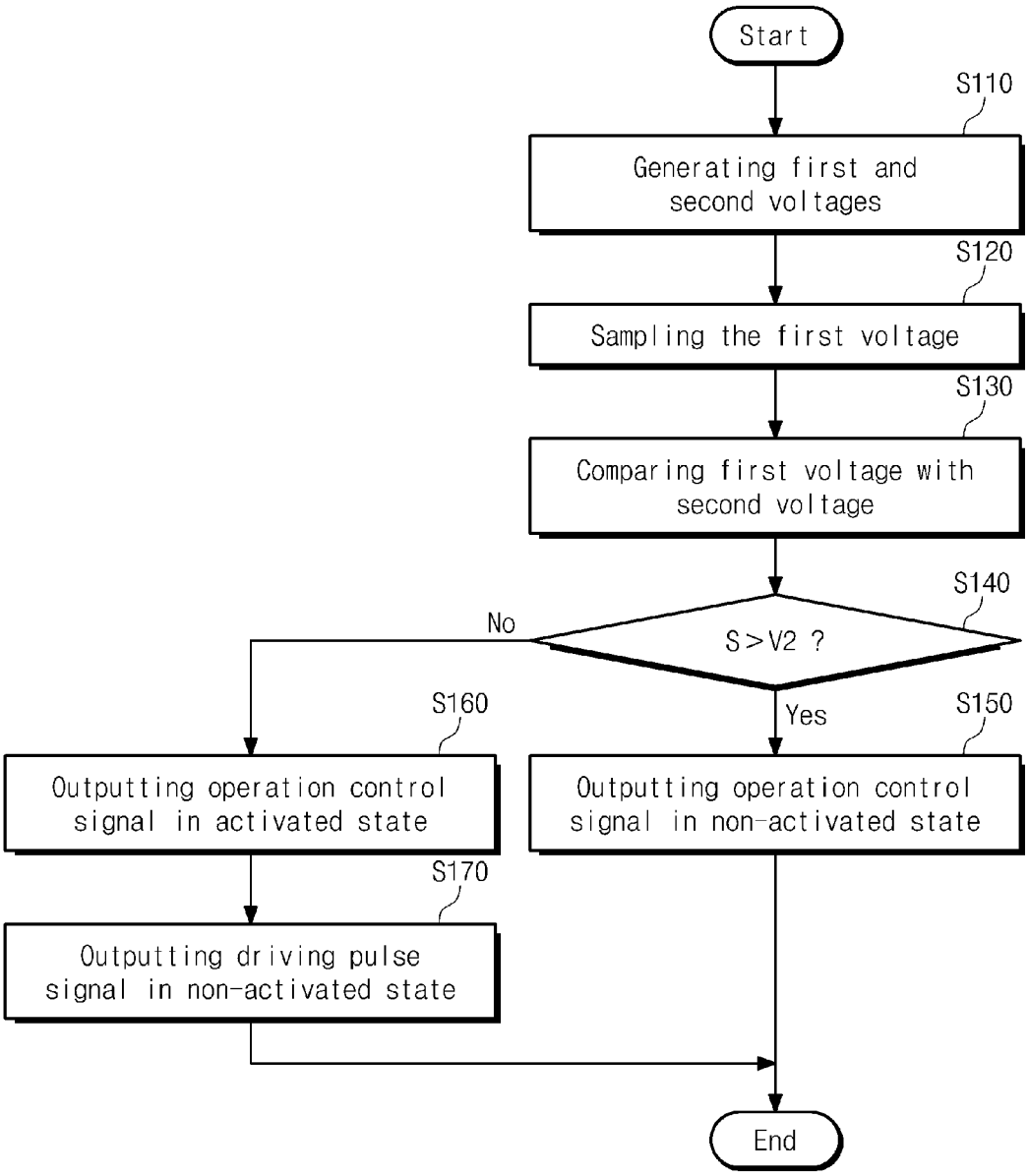
FIG. 8 is a flowchart showing an operation of a backlight unit, according to an exemplary embodiment of the present disclosure.

FIG. 8 is a flowchart showing the operation of the backlight unit, according to an exemplary embodiment of the present disclosure. Hereinafter, the operation of the backlight unit 500 is described for a case when the light emitting diode LEDn is shorted with reference to FIGS. 3 and 8.

The detector 530 generates the first and second voltages V1 and V2 with reference to the output voltage Vo output from the DC-DC converter 510 (S110). The detector 530 samples the first voltage V1 at predetermined time intervals (S120). The detector 530 compares the sample voltage S sampled at the predetermined intervals with the second voltage V2 (S130).

If the level of the sample voltage S is higher than that of the second voltage V2 (S140), the detector 530 outputs the operation control signal in the non-activated state (S150). In this case, the light emitting diodes LED1 to LEDn included in the light source part 520 are normally operated.

Conversely, if the level of the sample voltage S is lower than that of the second voltage V2 (S140), the detector 530 outputs the operation control signal in the activated state (S160). In this case, one or more light emitting diodes of the light emitting diodes LED1 to LEDn included in the light source part 520 are operated as a short circuit.

The driving controller 540 outputs the driving pulse signal in the non-activated state in response to receiving the operation control signal in the activated state from the detector 530 (S170). The driving pulse signal in the non-activated state causes the DC-DC converter 510 to not apply the output voltage Vo to the light source part 520.

Although the exemplary embodiments of the present system and method are described, it is understood that the present system and method are not limited to these exemplary embodiments. Instead, those of ordinary skill in the art would understand that various changes and modifications may be made without departing from the spirit and scope of the present system and method.

What is claimed is:

1. A method of driving a backlight unit, comprising:

generating each of a first voltage and a second voltage by utilizing an output voltage received directly from a DC-DC converter;

sampling the first voltage at a predetermined time interval to generate a sample voltage;

comparing a level of the sample voltage with a level of the second voltage to generate a compared result; and outputting an operation control signal according to the compared result to indicate whether to apply the output voltage to a light source.

2. The method of claim 1, wherein, if the compared result indicates that the level of the sample voltage is higher than the level of the second voltage, the operation control signal is maintained in an activated state that stops the output voltage from being applied to the light source.

3. The method of claim 1, wherein, if the compared result indicates that the level of the sample voltage is lower than the level of the second voltage, the operation control signal is maintained in a non-activated state that enables the output voltage to be applied to the light source.

4. The method of claim 1, wherein the second voltage is higher than the first voltage when the output voltage remains the same.

5. The method of claim 1, wherein the light source includes a single light emitting diode string with a plurality of light emitting diodes connected to each other in series.

6. A display device comprising:

a backlight unit comprising:

a DC-DC converter configured to generate an output voltage;

a single light emitting diode string with a plurality of light emitting diodes and outputting light in response to the output voltage received directly from the DC-DC converter, the light emitting diodes are connected to each other in series and configured to emit light, and a detector configured to generate each of a first voltage and a second voltage by utilizing the output voltage received directly from the DC-DC converter, sample the first voltage at a predetermined time interval to generate a sample voltage, and compare a level of the sample voltage with a level of the second voltage to generate a compared result; and a display panel configured to receive the light from the backlight unit to display an image, wherein the compared result determines whether the output voltage is applied to the light emitting diode string.

7. The display device of claim 6, wherein the detector is further configured to output an operation control signal based on the compared result.

8. The display device of claim 7, wherein the detector comprises:

a first voltage controller that is configured to output the first voltage with respect to the output voltage;

a second voltage controller that is configured to output the second voltage with respect to the output voltage;

a sampler that is configured to sample the first voltage at the predetermined time interval to generate the sample voltage; and a comparator that is configured to compare the sample voltage with the second voltage to output the operation control signal according to the compared result.

9. The display device of claim 8, wherein the second voltage controller is configured to output the second voltage at a higher level than that of the first voltage output from the first voltage controller when the output voltage remains the same.

10. The display device of claim 7, wherein, if the compared result indicates that one or more light emitting diodes are shorted among the light emitting diodes on the basis of the sample voltage being higher than the second voltage, the detector outputs the operation control signal in an activated state that stops the output voltage from being applied to the light emitting diode string.

11. The display device of claim 7, wherein, if the compared result indicates that one or more light emitting diodes are shorted among the light emitting diodes on the basis of the sample voltage being lower than the second voltage, the detector outputs the operation control signal in a non-activated state that enables the output voltage to be applied to the light emitting diode string.

12. The display device of claim 7, wherein, if the compared result indicates that one or more light emitting diodes are open among the light emitting diodes on the basis of the sample voltage being lower than the second voltage, the detector outputs the operation control signal in an activated state that stops the output voltage from being applied to the light emitting diode string.

13. The display device of claim 7, wherein the backlight unit comprises:

a driving controller that is configured to control a duty ratio of the driving pulse signal controlling the output voltage; and a light source part that comprises the light emitting diode string and is configured to output the light in response to the output voltage.

14. The display device of claim 13, wherein, if the compared result indicates that one or more light emitting diodes are shorted among the light emitting diodes on the basis of the sample voltage being higher than the second voltage level, the driving controller outputs the driving pulse signal in the non-activated state in response to the operation control signal in the activated state to stop the output voltage from being outputted by the DC-DC converter.

15. A display device comprising:

a backlight unit comprising:

a single light emitting diode string with a plurality of light emitting diodes that are connected to each other in series and configured to emit light, and a detector configured to generate a first voltage and a second voltage with respect to an output voltage for driving the single light emitting diode string, sample the first voltage at a predetermined time interval to generate a sample voltage, and compare a level of the sample voltage with a level of the second voltage to generate a compared result;

a display panel configured to receive light from the backlight unit to display an image, wherein the compared result determines whether the output voltage is applied to the light emitting diode string, and a timing controller that is configured to control the backlight unit, wherein the timing controller controls the operation of the backlight unit in response to the operation control signal, and the detector is further configured to output an operation control signal based on the compared result.

16. The display device of claim 15, wherein, if the compared result indicates that one or more light emitting diodes are shorted among the light emitting diodes on the basis of the sample voltage being higher than the second voltage, the detector applies the operation control signal in the activated state to the timing controller, and in response to the operation control signal in the activated state, the timing controller stops the operation of the backlight unit.

17. The display device of claim 15, wherein, if the compared result indicates that one or more light emitting diodes are open among the light emitting diodes on the basis of the sample voltage being lower than the second voltage, the detector applies the operation control signal in the activated state to the timing controller, and in response to the operation control signal in the activated state, the timing controller stops the operation of the backlight unit.

* * * * *